US007016626B2

(12) United States Patent
Yokomori et al.

(10) Patent No.: US 7,016,626 B2
(45) Date of Patent: Mar. 21, 2006

(54) ELECTROPHOTOGRAPHIC PHOTOSENSITIVE DRUM HAVING CAULKED FLANGES, PROCESS CARTRIDGE HAVING SUCH A DRUM, AND IMAGE FORMING APPARATUS HAVING SUCH A PROCESS CARTRIDGE

(75) Inventors: Kanji Yokomori, Kanagawa (JP); Kojiro Yasui, Shizuoka (JP); Tachio Kawai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/609,485

(22) Filed: Jul. 1, 2003

(65) Prior Publication Data

US 2004/0005169 A1 Jan. 8, 2004

(30) Foreign Application Priority Data

Jul. 4, 2002 (JP) ..... 2002-195980
Jun. 24, 2003 (JP) ..... 2003-179949

(51) Int. Cl.
*G03G 15/00* (2006.01)

(52) U.S. Cl. ..... 399/117

(58) Field of Classification Search ..... 399/117, 399/167, 111, 116, 119
See application file for complete search history.

(56) References Cited

U.S. PATENT DOCUMENTS 5,771,425 A * 6/1998 Yamada et al. ..... 399/111
5,839,028 A 11/1998 Nomura et al. ..... 399/109
5,878,309 A 3/1999 Nomura et al. ..... 399/111
5,903,803 A 5/1999 Kawai et al. ..... 399/116
5,940,657 A 8/1999 Yokomori et al. ..... 399/119
5,943,528 A 8/1999 Akutsu et al. ..... 399/110
5,950,049 A 9/1999 Yokomori et al. ..... 399/119
5,953,562 A 9/1999 Kawaguchi et al. ..... 399/117
6,029,031 A 2/2000 Yokomori et al. ..... 399/109
6,055,406 A 4/2000 Kawai et al. ..... 399/360
6,064,843 A 5/2000 Isobe et al. ..... 399/111
6,072,969 A 6/2000 Yokomori et al. ..... 399/119
6,115,567 A 9/2000 Kawai et al. ..... 399/106
6,128,454 A 10/2000 Kawai et al. ..... 399/116
6,163,665 A 12/2000 Watanabe et al. ..... 399/111
6,175,706 B1 1/2001 Watanabe et al. ..... 399/167
6,215,969 B1 4/2001 Nomura et al. ..... 399/111
6,226,478 B1 5/2001 Watanabe et al. ..... 399/117
6,240,266 B1 5/2001 Watanabe et al. ..... 399/117
6,324,364 B1 * 11/2001 Nomura et al. ..... 399/111
6,336,018 B1 1/2002 Kawai et al. ..... 399/117
6,345,164 B1 2/2002 Yokomori et al. ..... 399/119
6,381,430 B1 4/2002 Yokomori et al. ..... 399/119
6,459,869 B1 10/2002 Nittani et al. ..... 399/111

(Continued)

FOREIGN PATENT DOCUMENTS

JP 2000352897 A * 12/2000

*Primary Examiner*—Quana Grainger
(74) *Attorney, Agent, or Firm*—Fitzpatrick, Cella, Harper & Scinto

(57) ABSTRACT

An electrophotographic photosensitive drum for use in an electrophotographic image forming apparatus includes a cylinder and flanges provided on end portions in the axial direction of the cylinder. One flange has an outer peripheral portion, a hole portion and ribs, and the flange is caulked by bending part of the cylinder inwardly in the radial direction at two positions opposing each other across the hole portion, those two positions being other than positions at which the ribs intersect the outer peripheral portion in the extending direction of the ribs.

17 Claims, 11 Drawing Sheets

U.S. PATENT DOCUMENTS 6,463,232 B1 10/2002 Kawai et al. ..... 399/111
6,463,234 B1 10/2002 Arimitsu et al. ..... 399/113
6,473,580 B1 * 10/2002 Inomata ..... 399/167
6,480,687 B1 11/2002 Kawai et al. ..... 399/111
6,496,667 B1 12/2002 Shiratori et al. ..... 399/103
6,501,926 B1 12/2002 Watanabe et al. ..... 399/117
6,501,927 B1 12/2002 Watanabe et al. ..... 399/117
6,560,422 B1 5/2003 Kanno et al. ..... 399/106
2002/0031368 A1 3/2002 Kanno et al. ..... 399/103
2002/0110386 A1 8/2002 Kanno et al. ..... 399/111
2002/0110388 A1 8/2002 Yokomori et al. ..... 399/167
2003/0086715 A1 5/2003 Miura et al. ..... 399/27

* cited by examiner

ELECTROPHOTOGRAPHIC PHOTOSENSITIVE DRUM HAVING CAULKED FLANGES, PROCESS CARTRIDGE HAVING SUCH A DRUM, AND IMAGE FORMING APPARATUS HAVING SUCH A PROCESS CARTRIDGE

BACKGROUND OF THE INVENTION

1. Field of the Invention

The present invention relates to an electrophotographic photosensitive drum for use in a copier, printer and the like adopting an electrophotography system, a process cartridge employing the electrophotographic photosensitive drum and an electrophotographic image forming apparatus using the same.

2. Description of Related Art

The electrophotographic image forming apparatus forms an image on a recording medium using the electrophotographic-image-forming system. Then, the electrophotographic image forming apparatus includes, for example, an electrophotographic copier, an electrophotographic printer (e.g., a laser beam printer, an LED printer and the like), a facsimile unit, a word processor and the like.

The process cartridge is a cartridge in which charging means, developing means or cleaning means as process means is integrated with the electrophotographic photosensitive drum and this cartridge is attachable to/detachable from the electrophotographic image forming apparatus main body. At least one of the charging means, the developing means and the cleaning means as process means is integrated with the electrophotographic photosensitive drum so as to form a cartridge, which can be attached to/detached from the electrophotographic image forming apparatus main body. Alternatively, at least the developing means as process means is integrated with the electrophotographic photosensitive drum so as to form a cartridge, which can be attached to/detached from the electrophotographic image forming apparatus main body.

Conventionally, the image forming apparatus using the electrophotographic-image-forming process adopts a process-cartridge system in which the electrophotographic photosensitive drum and the process means, which acts on the electrophotographic photosensitive drum, are integrated so as to form a cartridge, which can be attached to/detached from the image forming apparatus main body. Because this process-cartridge system allows a user himself to carry out its maintenance without help of service personnel, the operability of this apparatus can be improved remarkably. For the reason, the process-cartridge system has been widely used in the image forming apparatus.

In such a process cartridge, its photosensitive drum is constructed so that flanges are fixed on end portions of a cylindrical electro-conductive body having a photosensitive layer provided on the surface thereof. The cylindrical electro-conductive body and the flanges are coupled firmly through caulking by bending part of the cylinder inwardly. Further, the photosensitive drum is journaled by a bearing disposed at a predetermined position of the cartridge casing such that it is capable of rotating integrally with a supporting shaft that is supported rotatably. Drive transmitting means, which receives a drive force from the image forming apparatus main body to rotate the photosensitive drum, is provided at an end of the supporting shaft.

The present invention is an advancement on the conventional technology.

SUMMARY OF THE INVENTION

An object of the present invention is to provide an electrophotographic photosensitive drum in which the rotational accuracy thereof is improved, a process cartridge, and an electrophotographic image forming apparatus.

Another object of the present invention is to provide an electrophotographic photosensitive drum which can suppress deformation of a hole portion for supporting the electrophotographic sensitive drum rotatably, a process cartridge, and an electrophotographic image forming apparatus.

A further object of the present invention is to provide an electrophotographic photosensitive drum having an improved looseness-resisting strength between the flange and the cylinder, a process cartridge, and an electrophotographic image forming apparatus.

A further object of the present invention is to provide an electrophotographic photosensitive drum having an improved rotational-resisting strength between the flange and the cylinder, a process cartridge, and an electrophotographic image forming apparatus.

A further object of the present invention, t is to provide an electrophotographic photosensitive drum for use in an electrophotographic image forming apparatus and supported rotatably by a drum shaft, comprising: a cylinder having an electrophotographic photosensitive member provided on the surface thereof; and flanges provided on end portions in the axial direction of the cylinder. One flange has an outer peripheral portion, a hole portion engaging the drum shaft, and multiple ribs extended radially in the radial direction, and the flange is caulked by bending part of the cylinder inwardly in the radial direction at two positions opposing each other across the hole portion, the two positions being other than positions at which the multiple ribs intersect the outer peripheral portion in the extending directions thereof.

A further object of the present invention is to provide a process cartridge attachable to/detachable from an electrophotographic image forming apparatus, comprising: (i) a cartridge-frame body; (ii) a drum shaft supported by the cartridge-frame body; and (iii) an electrophotographic photosensitive drum supported rotatably by the drum shaft, including a cylinder having an electrophotographic photosensitive member provided on the surface thereof; and flanges provided on end portions in the axial direction of the cylinder. One flange has an outer peripheral portion, a hole portion engaging the drum shaft, and multiple ribs extending radially in the radial direction, and the flange is caulked by bending part of the cylinder inwardly in the radial direction at two positions opposing each other across the hole portion, the two positions being other than positions at which the multiple ribs intersect the outer peripheral portion in the extending directions thereof.

A further object of the present invention is to provide an electrophotographic photosensitive drum for use in an electrophotographic image forming apparatus and supported rotatably by a drum shaft, comprising: a cylinder having an electrophotographic photosensitive member provided on the surface thereof; and flanges provided on end portions in the axial direction of the cylinder. One flange has an outer peripheral portion, a hole portion engaging the drum shaft, and a groove which engages a fixing pin provided in the drum shaft in a direction of intersecting the drum shaft. The groove extends in the radial direction and transmits a driving force of the drum shaft, and the flange is caulked by bending part of the cylinder inwardly in the radial direction at two positions opposing each other across the hole portion, at which the groove intersects the outer peripheral portion in an extending direction thereof.

A further object of the present invention is to provide a process cartridge attachable to/detachable from an electrophotographic image forming apparatus, comprising: (i) a cartridge-frame body; (ii) a drum shaft supported by the cartridge-frame body; and (iii) an electrophotographic photosensitive drum supported rotatably by the drum shaft, including a cylinder having an electrophotographic photosensitive member provided on the surface thereof; and flanges provided on end portions in the axial direction of the cylinder. One flange has an outer peripheral portion, a hole portion engaging the drum shaft, and a groove which engages a fixing pin provided in the drum shaft in a direction intersecting the drum shaft. The groove extends in the radial direction and transmits a driving force of the drum shaft, and the flange is caulked by bending part of the cylinder inwardly in the radial direction at two positions opposing each other across the hole portion, at which the groove intersects the outer peripheral portion in an extending direction thereof.

A further object of the present invention is to provide an image forming apparatus which allows a process cartridge to be attached/detached for forming an image on a recording medium, comprising: (i) a loading portion on which the process cartridge is mounted detachably; (ii) a process cartridge loaded on the loading portion, the process cartridge including a cartridge-frame body, a drum shaft supported by the cartridge-frame body, and an electrophotographic photosensitive drum supported rotatably by the drum shaft, the electrophotographic photosensitive drum including a cylinder having an electrophotographic photosensitive member provided on the surface thereof, and flanges provided on end portions in an axial direction of the cylinder, wherein one flange has an outer peripheral portion, a hole portion engaging the drum shaft, and multiple ribs extended radially in the radial direction, and the flange is caulked by bending part of the cylinder inwardly in the radius direction at two positions opposing each other across the hole portion, the two positions being other than positions at which the multiple ribs intersect the outer peripheral portion in the extending directions thereof; and (iii) carrying means for carrying the recording medium.

A further object of the present invention is to provide an image forming apparatus which allows a process cartridge to be attached/detached for forming an image on a recording medium, comprising: (i) a loading portion on which the process cartridge is loaded detachably; (ii) a process cartridge loaded on the loading portion, the process cartridge including a cartridge-frame body, a drum shaft supported by the cartridge-frame body and an electrophotographic photosensitive drum supported rotatably by the drum shaft, the electrophotographic photosensitive drum including a cylinder having an electrophotographic photosensitive member provided on the surface thereof and flanges provided on end portions in the axial direction of the cylinder, wherein one the flange has an outer peripheral portion, a hole portion engaging the drum shaft, and a groove which engages a fixing pin provided in the drum shaft in a direction intersecting the drum shaft, the groove extending in the radial direction and transmitting a driving force of the drum shaft, and the flange is caulked by bending part of the cylinder inwardly in the radial direction at two positions opposing each other across the hole portion, at which the groove intersects the outer peripheral portion in an extending direction thereof; and (iii) carrying means for carrying the recording medium.

A further object of the present invention is to provide an electrophotographic photosensitive drum for use in an electrophotographic image forming apparatus and supported rotatably by a drum shaft, comprising:

a cylinder having an electrophotographic photosensitive member provided on a surface thereof; and a flange provided on an end portion in an axial direction of the cylinder.

The flange comprises:

an outer peripheral portion;

a hole portion engaging the drum shaft; and a groove which engages a fixing pin provided in the drum shaft in a direction intersecting the drum shaft. The groove extends in the radial direction and transmits a driving force of the drum shaft. The flange is caulked by bending a part of the cylinder inwardly in the radial direction at two positions located along the outer peripheral portion between a position in which the groove intersects the outer peripheral portion in an extending direction thereof and a position in which a line passing through a center of the hole portion and extending at an angle of 45° with respect to the extending direction of the groove intersects the outer peripheral portion, the two positions being opposed with each other across a line intersecting the extending direction of the groove. A further object of the present invention is to provide a process cartridge attachable to/detachable from an electrophotographic image forming apparatus, comprising:

(i) a cartridge-frame body;

(ii) a drum shaft supported by the cartridge-frame body;

(iii) an electrophotographic photosensitive drum supported rotatably by the drum shaft, including a cylinder having an electrophotographic photosensitive member provided on the surface thereof; and a flange provided on an end portion in the axial direction of the cylinder; and (iv) process means for acting on the electrophotographic photosensitive drum.

The flange includes:

an outer peripheral portion;

a hole portion engaging the drum shaft; and a groove which engages a fixing pin provided in the drum shaft in a direction intersecting the drum shaft, the groove extending in the radial direction and transmitting a driving force of the drum shaft.

The flange is caulked by bending a part of the cylinder inwardly in the radial direction at two positions being located along the outer peripheral portion between a position in which the groove intersects the outer peripheral portion in an extending direction thereof and a position in which a line passing through the center of the hole portion and extending at an angle of 45° with respect to the extending direction of the groove intersects the outer peripheral portion, the two positions being opposed with each other across a line intersecting the extending direction of the groove.

A further object of the present invention is to provide an image forming apparatus which allows a process cartridge to be attached/detached for forming an image on a recording medium, comprising:

(i) loading portion on which the process cartridge is mounted detachably;

(ii) a process cartridge loaded on the loading portion, the process cartridge including a cartridge-frame body, a drum shaft supported by the cartridge-frame body, an electrophotographic photosensitive drum supported rotatably by the drum shaft, process means for acting on the electrophotographic photosensitive drum, and the electrophotographic photosensitive drum having a cylinder having an electrophotographic photosensitive member provided on the surface thereof, and a flange provided on an end portion in an axial direction of the; and (iii) carrying means for carrying the recording medium.

The flange comprises:

an outer peripheral portion;

a hole portion engaging the drum shaft; and a groove extending in the radial direction and engaging a fixing pin provided in the drum shaft in a direction intersecting the drum shaft and the groove transmitting a driving force of the drum shaft. The flange is caulked by bending part of the cylinder inwardly in the radial direction at two positions located along the outer peripheral portion between a position in which the groove intersects the outer peripheral portion in an extending direction thereof and a position in which a line passing through the center of the hole portion and extending at an angle of 45° with respect to the extending direction of the groove intersects the outer peripheral portion, the two positions being opposed with each other across a line intersecting the extending direction of the groove.

DETAILED DESCRIPTION OF THE PREFFERED EMBODIMENTS

First Embodiment (Entire Configuration of Multi-Color Image Forming Apparatus)

Figure 1:
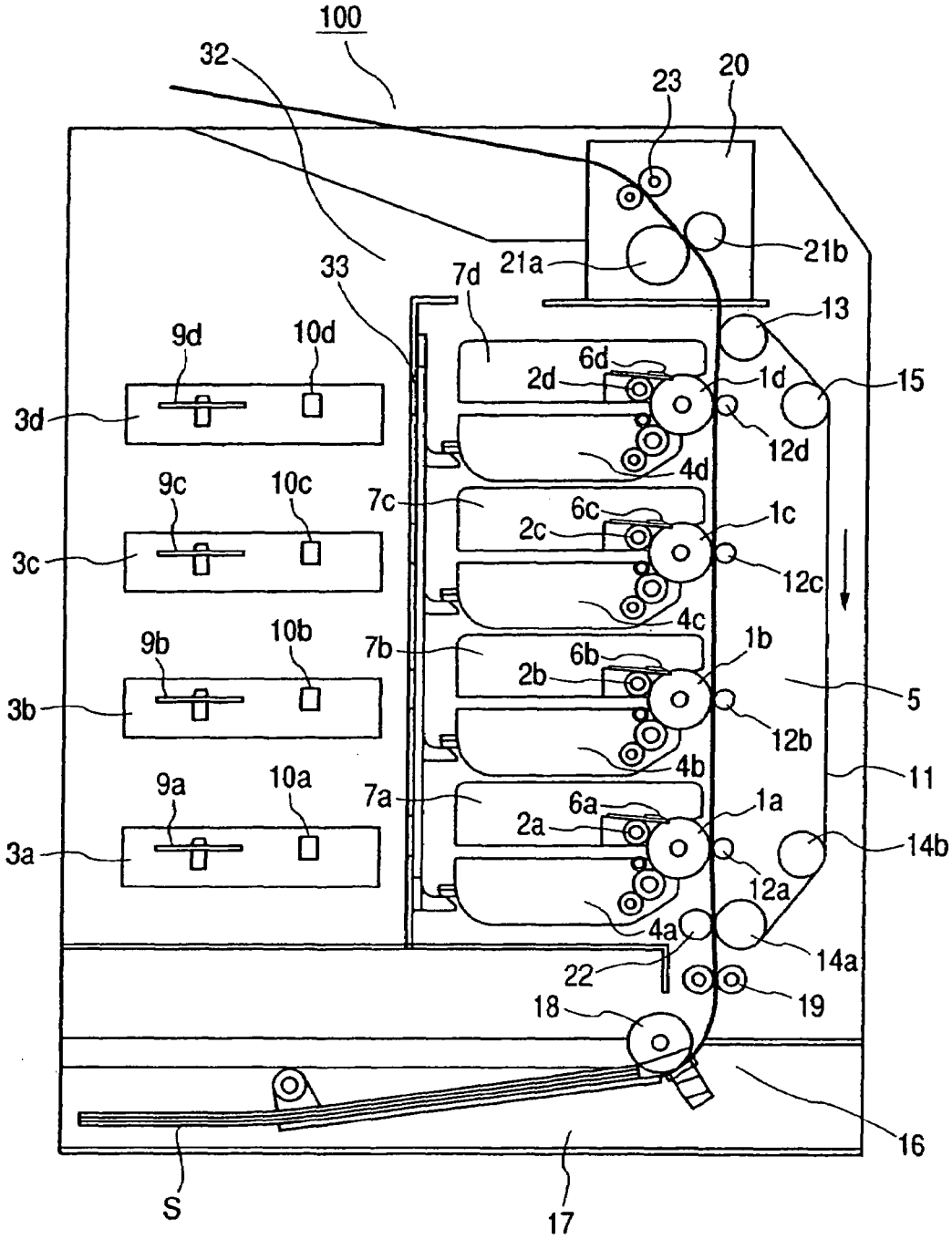
FIG. 1 is a sectional view of an entire image forming apparatus according to an embodiment of the present invention.

The entire configuration of a multi-color image forming apparatus will be described schematically with reference to FIG. 1. FIG. 1 is a longitudinal sectional view showing the entire configuration of a full-color laser-beam printer main body 100, which is an embodiment of the multi-color image forming apparatus.

The multi-color image forming apparatus 100 shown in the same figure comprises four photosensitive drums 1*a*, 1*b*, 1*c*, 1*d* disposed in parallel vertically. The photosensitive drum 1 is rotated counterclockwise in the same figure by driving means (not shown). Around the photosensitive drum 1 are disposed in order along the rotation direction a charging unit 2 (2*a*, 2*b*, 2*c*, 2*d*) for charging the surface of the photosensitive drum 1 equally with electricity, a scanner unit (3*a*, 3*b*, 3*c*, 3*d*) for forming an electrostatic latent image on the photosensitive drum 1 by irradiating the drum 1 with a laser beam based on image information, a developing unit 4 (4*a*, 4*b*, 4*c*, 4*d*) for applying toner to the electrostatic latent image so as to develop the latent image as a toner image, an electrostatic transferring unit 5 for transferring the toner image on the photosensitive drum 1 to a transfer-object material S, and a cleaning unit (6*a*, 6*b*, 6*c*, 6*d*) for removing residual toner left on the surface of the photosensitive drum 1 after the transferring.

The photosensitive drum 1, the charging unit 2, the developing unit 4 and the cleaning unit are integrated in a cartridge so as to form a process cartridge 7. Hereinafter, the photosensitive drum 1 will be described in order.

The photosensitive drum 1 is constructed by coating the peripheral surface of, for example, an aluminum cylinder 30 mm in diameter with an organic photoconductive layer (OPC photosensitive member part). The photosensitive drum 1 is supported rotatably through supporting members at both its end portions and rotated counterclockwise by a driving force which is transmitted to one end portion from a driving motor (not shown).

As the charging unit 2, it is permissible to employ a contact-type charging unit. The charging member is an electro-conductive roller formed in the form of a roller. By bringing this roller into a contact with the surface of the photosensitive drum 1 and then applying a charging-bias voltage to this roller, the surface of the photosensitive drum 1 is equally charged with electricity.

The scanner unit is disposed substantially in a horizontal direction of the photosensitive drum 1, so that image light corresponding to an image signal is generated by a laser diode (not shown) onto a polygon mirror (9*a*, 9*b*, 9*c*, 9*d*) which is rotated rapidly by a scanner motor (not shown). The image light reflected by the polygon mirror is projected selectively to the surface of the photosensitive drum 1 already charged with electricity through an imaging lens (10*a*, 10*b*, 10*c*, 10*d*) so as to form an electrostatic latent image. As shown in FIG. 1, the scanner unit is formed longer in the longitudinal direction than the pitch between right and left side plates and installed such that its projection portion 33 is projected outside from an opening hole in a side plate 32. As for a method of pushing the scanner unit, the scanner unit is pushed downward by about 45° by a pressure spring with a force of about 1 kgf. Consequently, the scanner unit is pushed securely against a contact plate so that its position is determined.

Figure 2:
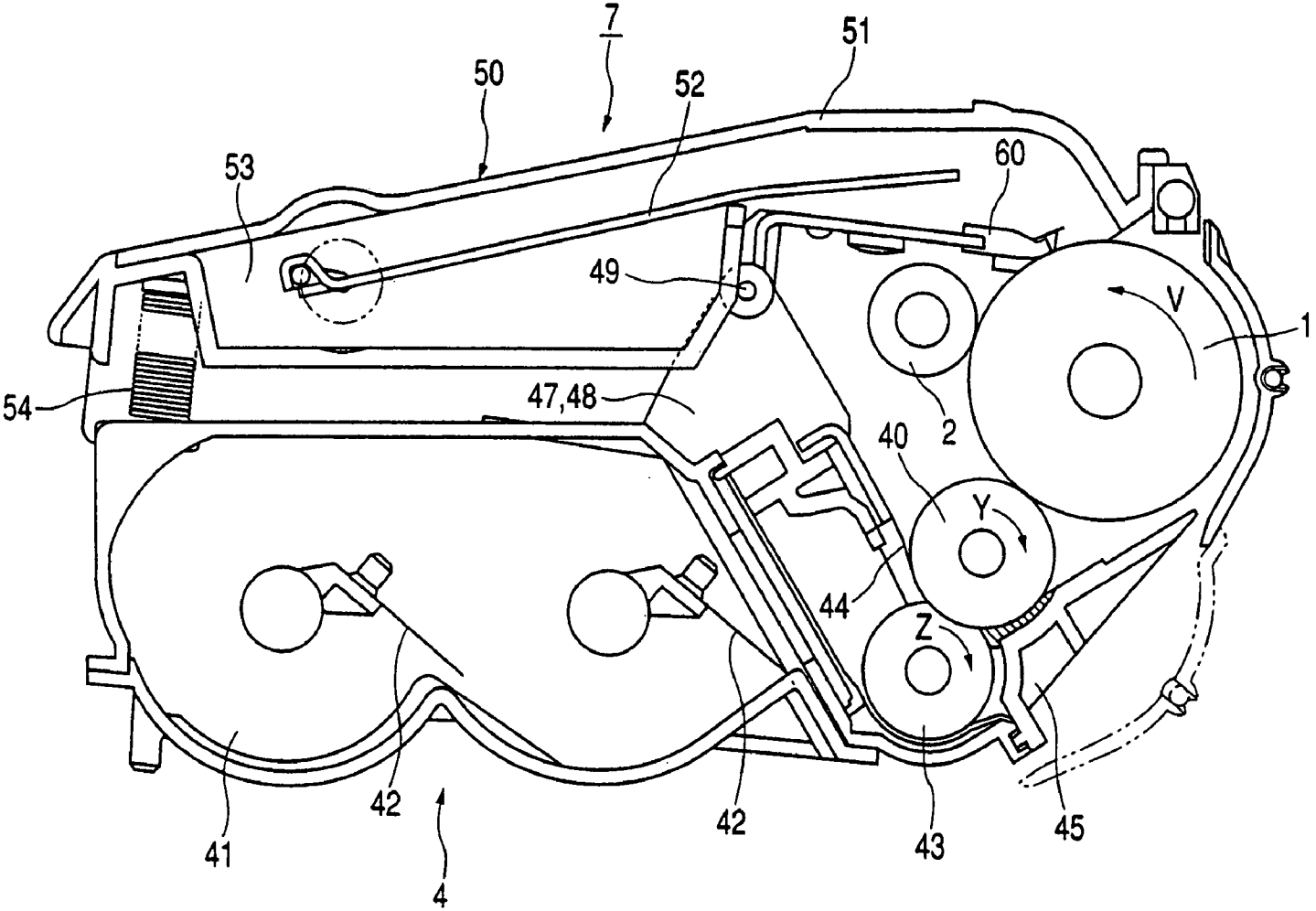
FIG. 2 is a sectional view of a process cartridge according to the embodiment of the present invention.

The developing unit 4 shown in FIG. 2 is constituted of toner containers 41 which contain respective color toners of yellow, magenta, cyan and black. Toner in each toner container 41 is fed to a toner-supply roller 43, also called a toner-supplying roller, by a feeding mechanism 42. Further, the outer periphery of a developing roller 40, which is rotated clockwise, is coated with toner by a developing blade 44, which is pushed into contact with the outer periphery of a toner-supplying roller 43 and the developing roller 40, which are rotated clockwise and further, the toner is supplied with an electrical charge.

By applying a developing bias on the developing roller 40, which opposes the photosensitive drum 1 on which the latent image is formed, toner development is carried out on the photosensitive drum 1 corresponding to the latent image.

An electrostatic transfer belt 11 is disposed such that it opposes all the photosensitive drums 1*a*, 1*b*, 1*c*, 1*d* and rotated as if it makes contact with the same drums. The electrostatic transferring belt 11 is constituted of a film-like member having an inherent resistance of $10^{11}$ to $10^{14}$ Ω·cm and about 150 μm. This electrostatic transferring belt 11 is supported in a vertical direction by four rollers. The transfer-object material S is attracted electrostatically by the outer peripheral surface on the left side in the same figure and the belt is moved cyclically so that the transfer-object material S comes into a contact with the photosensitive drum 1. Consequently, the transfer-object material S is carried to a transferring position by the electrostatic transferring belt 11 and a toner image on the photosensitive drum 1 is transferred.

Transferring rollers (12*a*, 12*b*, 12*c*, 12*d*) are disposed in parallel at positions opposing the four photosensitive drums 1*a*, 1*b*, 1*c*, 1*d* such that they are in contact with the inside of the electrostatic transferring belt 11. Positive polarity charge is applied from these transferring rollers to the transfer-object material S through the electrostatic transferring belt 11. A negative-polarity toner image on the photosensitive drum 1 is transferred to a paper in contact with the photosensitive drum 1.

The electrostatic transferring belt 11 is a belt about 700 mm in length and 150 μm in thickness and stretched over four rollers comprised of a belt driving roller 13, driven rollers 14*a*, 14*b* and a tension roller 15. Then, the belt is rotated in a direction indicated with an arrow. Consequently, while the above-described electrostatic transferring belt 11 is moved cyclically and the transfer-object material S is carried from the side of the driven roller 14*a* to the side of the driving roller 13, the toner image is transferred.

A paper feeding portion 16 carries the transfer-object material S to an image-forming portion. Multiple pieces of transfer-object materials S are accommodated in a paper cassette 17. Upon formation of an image, the paper-feeding roller 18 (semi-lunar roller) and a pair of registration rollers 19 are driven corresponding to an image-forming action and every transfer-object material S is separated and fed from the paper cassette 17. A leading edge of the transfer-object material S comes into contact with the pair of registration rollers 19 and is stopped for a while. Then, after a loop is formed, the transfer-object material S is fed to the electrostatic transferring belt 11 by the pair of registration rollers 19 synchronously with rotation of the electrostatic transferring belt 11 and an image write-start position.

A fixing portion 20 fixes a multi-color toner image transferred to the transfer-object material S and is comprised of a heating roller 21*a*, which is rotated, and a pressure roller 21*b*, which makes firm contact with the heating roller 21*a* so as to apply heat and pressure to the transfer-object material S.

That is, after the toner image on the photosensitive drum 1 is transferred, when the transfer-object material S passes the fixing portion 20, it is carried by a pair of fixing rollers and supplied with heat and pressure by the pair of fixing rollers. Consequently, the multi-color toner image is fixed on the surface of the transfer-object material S.

As for the operation for image formation, the process cartridges 7*a*, 7*b*, 7*c*, 7*d* are driven successively corresponding to a print timing and the photosensitive drums 1*a*, 1*b*, 1*c*, 1*d* are driven counterclockwise corresponding to the former driving. Then, the scanner units 3*a*, 3*b*, 3*c*, and 3*d*, corresponding to the respective process cartridges 7 are driven successively. Through this driving, the charging roller 2 applies a uniform electrical charge on the peripheral face of the photoelectric drum 1. The scanner unit exposes the peripheral face of the photosensitive drum 1 corresponding to an image signal so as to form an electrostatic latent image on the peripheral face of the photosensitive drum 1. The developing roller 40 in the developing unit 4 transfers toner to a low-potential portion of an electrostatic latent image and forms (develops) a toner image on the peripheral face of the photosensitive drum 1. Then, at a timing in which a leading edge of a toner image on the peripheral face of the photosensitive drum 1 in the uppermost stream is rotated up to a point opposing the electrostatic transferring belt 11, the pair of registration rollers 19 starts rotation such that a print-startup position of the transfer-object material S meets the opposing point, and then, the transfer-object material S is fed to the electrostatic transferring belt 11.

The transfer-object material S is brought into a firm contact with the outer periphery of the electrostatic transferring belt 11 in a condition that it is sandwiched between an electrostatic attracting roller 22 and the electrostatic transferring belt 11. Then, by applying a voltage between the electrostatic transferring belt 11 and the electrostatic attracting roller 22, an electrical charge is induced between the transfer-object material S, which is a dielectric body, and a dielectric layer of the electrostatic transferring belt 11, so that the transfer-object material is electrostatically attracted on the outer periphery of the electrostatic transferring belt 11. Consequently, the transfer-object material S is attracted stably by the electrostatic transferring belt 11 and carried to a transferring portion located in the most downstream portion of the belt 11.

The toner image of each photosensitive drum 1 is transferred to the transfer-object material S successively by an electric field formed between each photosensitive drum 1 and the transfer roller. After four-color toner images are transferred, the transfer-object material S is separated from the electrostatic transfer belt 11 due to the curvature of the belt driving roller 13 and carried into the fixing portion 20. After the aforementioned toner image is fixed thermally by the fixing portion 20, the transfer-object material S is discharged out of the main body by a pair of paper-discharge rollers 23 in a condition that an image side faces downward.

Figure 3:
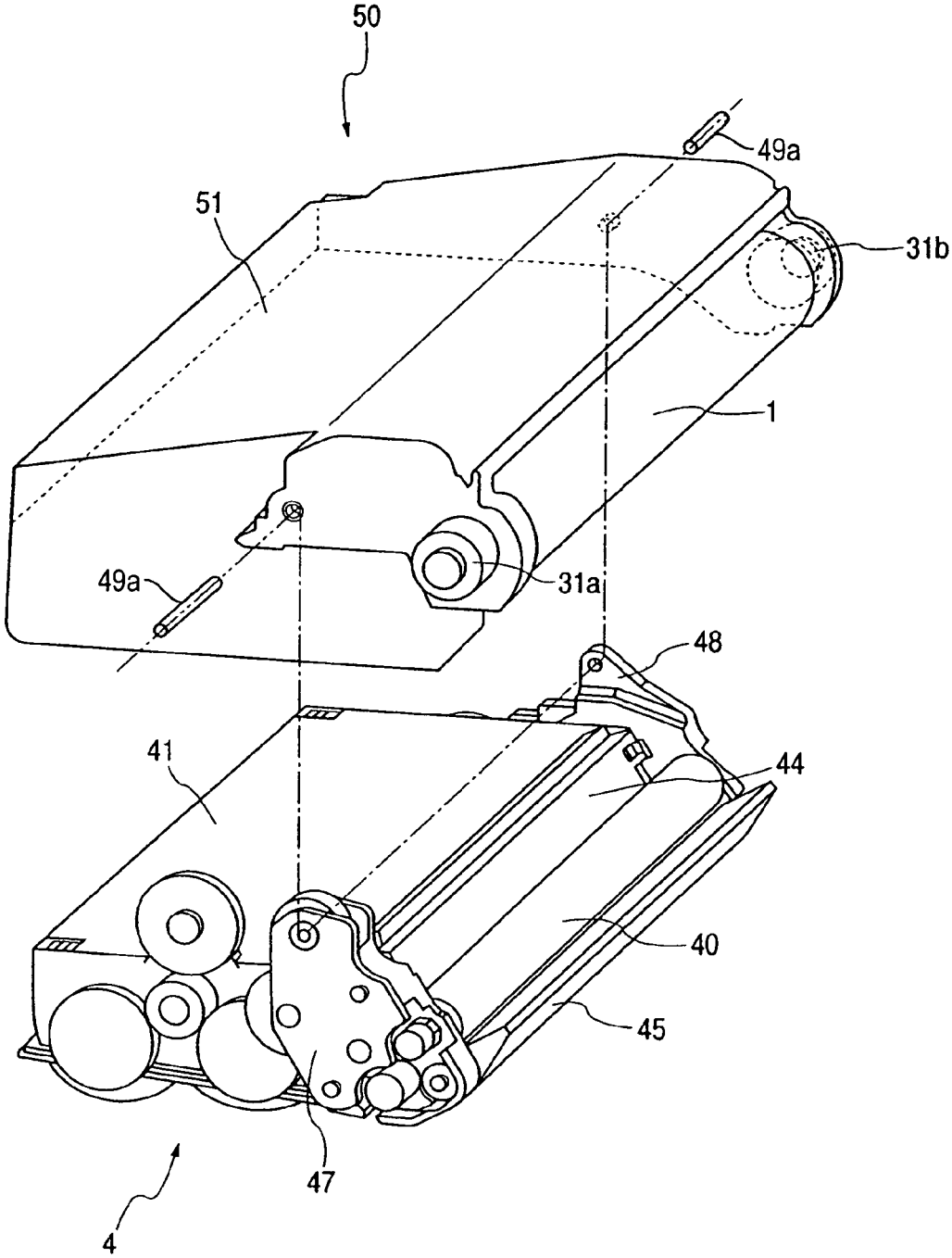
FIG. 3 is a schematic perspective view of the process cartridge according to the embodiment of the present invention.

Next, a process cartridge formed by executing the present invention will be explained in detail with reference to FIGS. 2 and 3. FIGS. 2 and 3 show a main section and a perspective of the process cartridge 7 accommodating toner, respectively. In the meantime, respective process cartridges 7*a*, 7*b*, 7*c*, 7*d* for yellow, magenta, cyan and black have the same configuration.

The process cartridge 7 is comprised of the photosensitive drum 1, which is a drum-like electrophotographic photosensitive member for carrying an image, a photosensitive-drum unit 50 provided with charging means and cleaning means, and the developing unit having developing means for developing an electrostatic latent image on the photosensitive drum 1.

In the photosensitive-drum unit 50, the photosensitive drum 1 is mounted to be freely rotatably on a cleaning-frame body 51 through bearings (31*a*, 31*b*). The primary charging means 2 for charging the surface of the photosensitive drum 1 equally and a cleaning blade 60 for removing developer (toner) left on the photosensitive drum are disposed on the peripheral face of the photosensitive drum 1. Residual toner removed from the surface of the photosensitive drum 1 by the cleaning blade 60 is carried to a waste-toner chamber 53 provided behind the cleaning-frame body 51 successively by a toner feeding mechanism 52. Then, a driving force of a driving motor (not shown) is transmitted to an end in the backward direction (shown) so as to rotate the photosensitive drum 1 counterclockwise corresponding to an image-forming operation.

The developing unit 4 is comprised of a developing roller 40 which keeps contact with the photosensitive drum 1 and is rotated in a Y direction indicated with an arrow, a toner container 41 accommodating toner and a developing-frame body 45. The developing roller 40 is supported to be freely rotatably on the developing-frame body 45 through a bearing member. A toner-supply roller 43 and a developing blade 44, which make contact with the developing roller 40 and are rotated in a Z direction indicated with an arrow, are disposed on the peripheral face of the developing roller 40. Further the toner container 41 accommodates a toner-carrying or toner-agitating mechanism 42 which agitates accommodated toner and carries it to the toner-supply roller 43.

The developing unit 4 adopts a hanging structure in which the entire developing unit 4 is supported to freely swing with respect to the photosensitive-drum unit 50 around a supporting shaft 49*a* provided on bearing members 47, 48 mounted on both ends of the developing unit 4. In a condition that the process cartridge 7 is not loaded on a printer main body yet, the developing roller 40 is always urged by a pressure spring 54 with a rotary moment around the supporting shaft 49*a* so as to make contact with the photosensitive drum 1. The toner container 41 of the developing unit 4 has a rib provided integrally therewith which separating means (which will be described later) of the printer main body 100 comes into a contact with when the developing roller 40 is separated from the photosensitive drum 1.

Upon development, toner accommodated by a toner-agitation mechanism 42 is carried to the toner-supply roller 43. Then, the toner supply roller 43, which is rotated in a Y direction indicated with an arrow, makes a sliding contact with the developing roller 40, which is rotated in a Z direction indicated with an arrow, so as to supply toner to the developing roller 40, so that toner is carried on the developing roller 40. Toner carried by the developing roller 40 reaches the developing blade 44 with a rotation of the developing roller 40. Then, the developing blade 44 regulates the amount of toner so as to provide with a desired quantity of electrical charge and form a predetermined thin toner layer. The regulated toner is carried to a developing portion at which the photosensitive drum 1 and the developing roller 40 contact each other with a rotation of the developing roller 40. The toner adheres to the electrostatic latent image formed on the surface of the photosensitive drum 1 by DC development bias applied from a power supply (not shown) to the developing roller 40 and the latent image is developed. Residual toner that is not used for development and left on the surface of the developing roller 40 is returned into the developing unit with a rotation of the developing roller 40 and scraped from the developing roller 40 by a friction portion which makes a sliding contact with the toner-supply roller 43 and is collected. The collected toner is agitated and mixed with remaining toner by the toner-agitation mechanism 42.

In a contact-developing system in which development is executed with the photosensitive drum 1 and the developing roller 40 in contact with each other proposed by the present invention, it is preferable that the photosensitive drum 1 is solid, while the developing roller 40 used for this purpose has an elastic body. As this elastic body, a single solid rubber layer or a solid rubber layer coated with resin coating, considering performance of providing toner with charge, is used.

Figure 4:
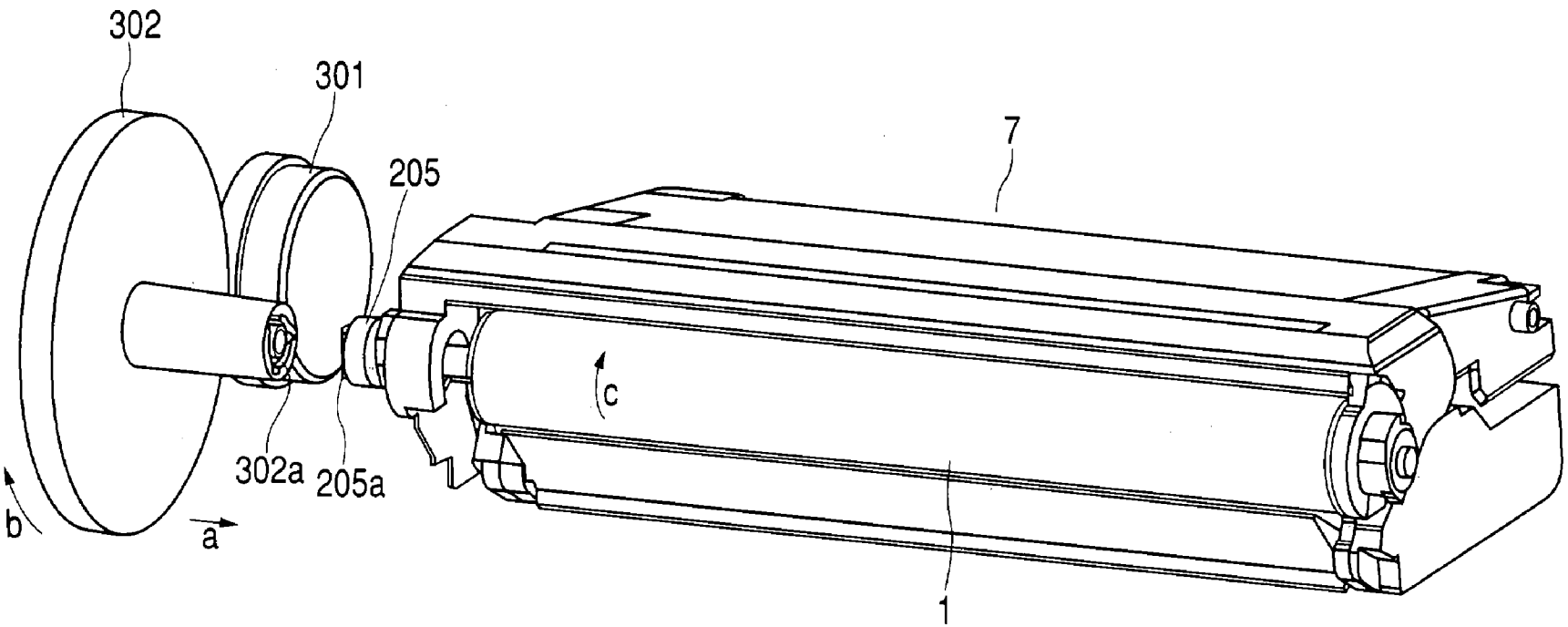
FIG. 4 is a schematic view of a method of driving a photosensitive drum according to the embodiment of the present invention.
Figure 5:
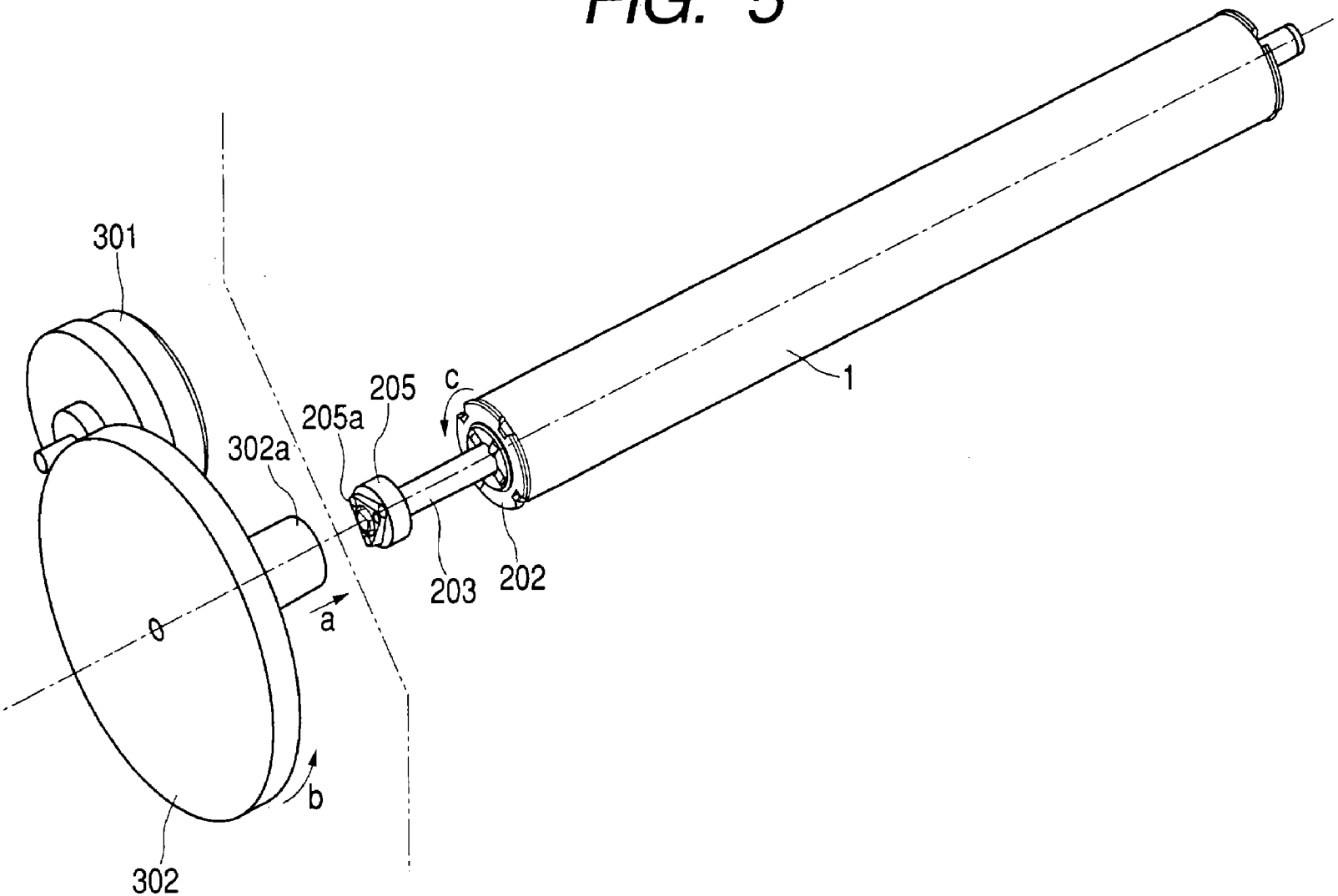
FIG. 5 is a schematic diagram of the method of driving a photosensitive drum according to the embodiment of the present invention.

FIGS. 4 and 5 show schematic diagrams of a method of driving the photosensitive drum 1 of the present invention.

FIG. 5 shows no components except for the photosensitive drum 1 and the driving member. The element on the right side of the two-dots and chain line is a process cartridge while the elements on the left side on this line are components contained in the image forming apparatus main body.

If the process cartridge 7 is inserted into the image forming apparatus main body, a drum-driving gear 302 of the main body is slid by the pressure of a spring (not shown) in a direction indicated by arrow a.

Then, a twisted hole 302*a* having a substantially regular triangular section provided in a leading edge of the drum-driving gear 302 engages a triangular column 205*a* having a substantially regular triangular section of a driving-force transmitting member 205 provided at the leading edge of the drum unit.

If a motor 301 of the main body is rotated, the drum-driving gear 302 is rotated in a direction indicated by arrow b so that the drum cylinder of the photosensitive drum 1, which is rotatable integrally with the shaft through the engaging driving-force transmitting member 205, is rotated in a direction indicated by arrow c.

Even if the relation between the substantially regular triangular twisted column and the twisted hole is inverse, the same function is ensured.

As for the twisting direction of the triangle, twisting in a direction in which the triangles pull each other when they are rotated prevents them from being separated from each other during a rotation.

Figure 6:
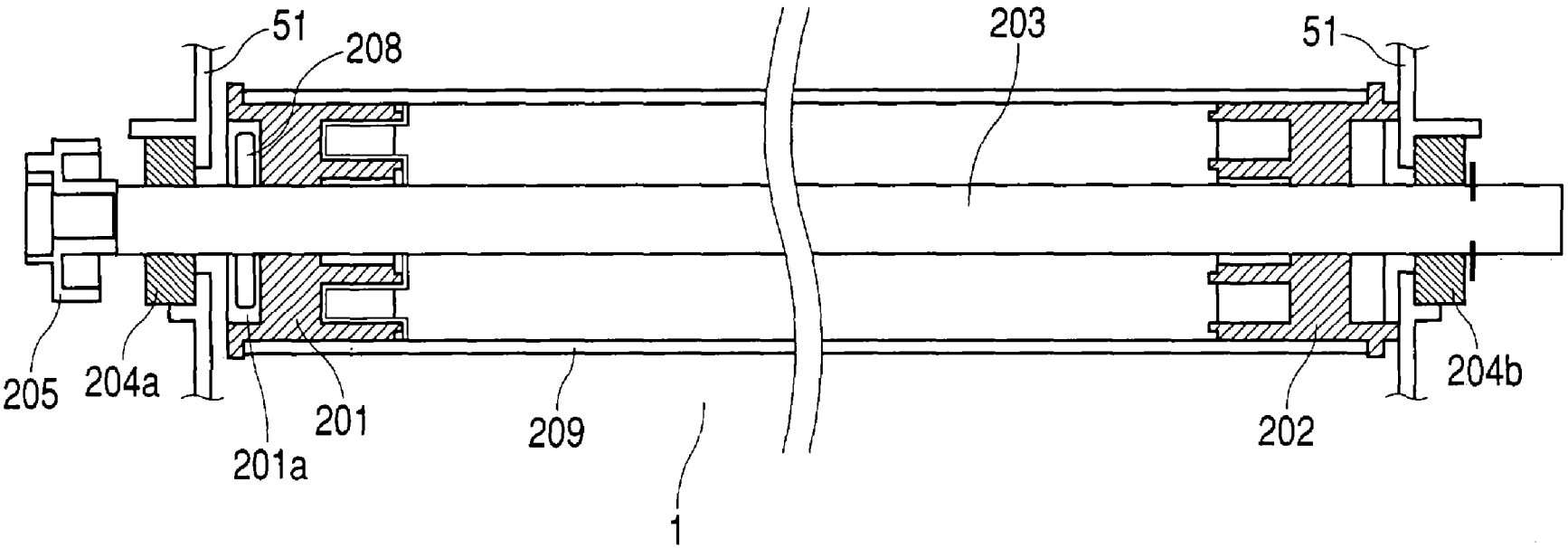
FIG. 6 is a sectional view of a photosensitive drum unit according to the embodiment of the present invention.

FIG. 6 shows a schematic diagram of the rotation-supporting structure of the photosensitive drum 1 in the process cartridge 7.

The photosensitive drum 1 is, for example, an aluminum cylinder 30 mm in diameter and has resin made flanges 201, 202 on both ends.

An outside diameter portion of each of the flanges 201, 202 engages an inner diameter of a cylinder 209 and contains a through hole 201*c*, also called an inside diameter hole, an inner peripheral portion, and an inside diameter portion, coaxial with the outside diameter portion of the flange.

The drum shaft 203, which is rotated integrally with the photosensitive drum 1, engages the through hole portion in each of the flanges 201, 202. The flanges 201, 202 are formed integrally with resin. As the resin, it is preferable to use polyacetal, polycarbonate, ABS, polystyrene, nylon, PPS, PBT, polyketone or the like from the viewpoints of accuracy and strength.

The drum shaft 203 is made of a metallic rod such as iron and according to this embodiment, the surface of a free-cutting steel rod is plated.

The drum shaft 203 is extended outwardly in the longitudinal direction of the photosensitive drum 1. Bearing members 204*a*, 204*b*, which support the drum shaft 203 rotatably, are disposed on the extended portion. Because the bearing members 204*a*, 204*b* are fixed on the bearing-member supporting portion of the cleaning-frame body 51, the photosensitive drum 1 is located on the cleaning-frame body 51 through the bearing members 204*a*, 204*b*.

Because the outer peripheral portion of each of the bearing members 204*a*, 204*b* is fixed on a side plate of the main body, the photosensitive drum 1 is positioned accurately on the image forming apparatus main body.

A D-cut hole in the driving-force transmitting member 205 is fit to a D-cut shape of an end portion of the drum shaft 203, so that the drum shaft 203 and the driving-force transmitting member 205 become rotatable integrally.

The drum shaft 203 contains a hole which is perpendicular to the axial direction and passes the center of the shaft and a fixing pin 208 is fit therein with pressure.

From the viewpoint of the strength of the fixing pin 208, it is preferable that a metallic parallel pin or a spring pin is inserted into the drum shaft 203.

The fixing pin 208 engages a groove 201*a* provided in the drum flange 201, so that the drum 1 and the drum shaft 203 are rotated integrally. The width of the groove 201*a* in the drum flange 201 is set to a dimension which causes no clearance relative to the outside diameter of the fixing pin 208 in the drum-rotation direction. The width of the groove 201*a* is smaller than the diameter of the through hole 201*c*.

Figure 7:
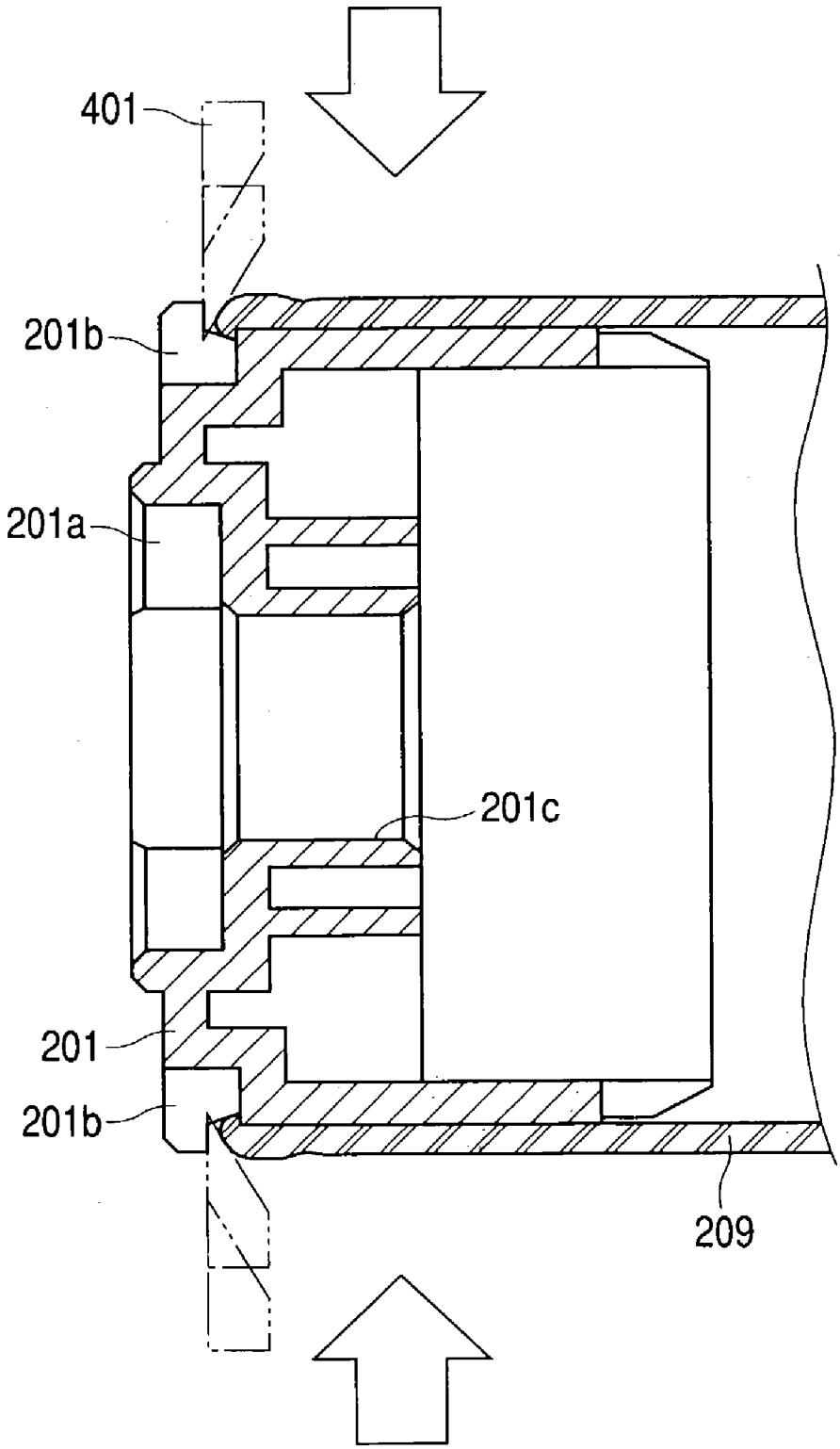
FIG. 7 is a sectional view of a method of caulking a flange according to the embodiment of the present invention.

To intensify the coupling strength between the cylinder 209 of the photosensitive drum and the flange 201, as shown in FIG. 7, an end portion of the cylinder 209 in the axial direction is partly bent inwardly in the radial direction. That is, according to this embodiment, the end portion of the cylinder 209 of the photosensitive drum partly falls down inwardly by using a metallic punch 401 to penetrate the cylinder 209 by about 1.5 mm up to a predetermined position from opposing peripheral directions (direction indicated with an arrow in the same figure) so as to caulk this portion (hereinafter referred to as caulking portions 209*a*, 209*b*). The drum flange 201 has a recess portion 201*b* for the portion to be fallen down. Consequently, a high looseness-resisting strength and rotation-resisting strength are obtained because the end portion of the photosensitive drum 1 partly bites the recess portion 201*b* in the drum flange 201.

Figure 8:
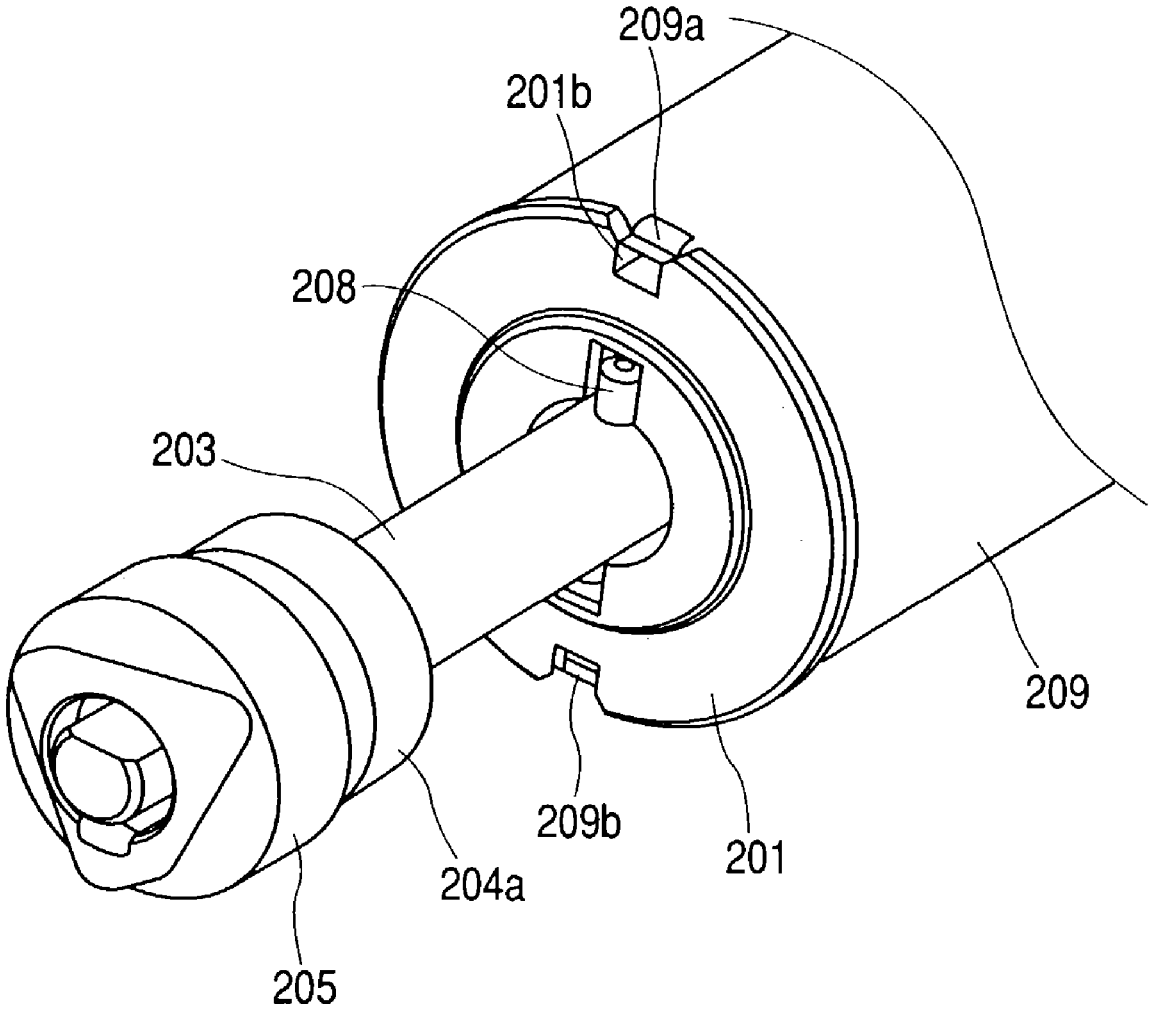
FIG. 8 is a schematic perspective view showing a condition in which the flange is caulked in the photosensitive drum according to the embodiment of the present invention.

FIG. 8 shows schematically the caulked drum-unit end portion. FIG. 8 does not indicate any components but main ones. At the time of the previous caulking, the inside diameter hole 201*c* in the flange is pushed by the punch 401 and crushed so that it becomes slightly elliptic (FIGS. 9 and 10).

Figure 9:
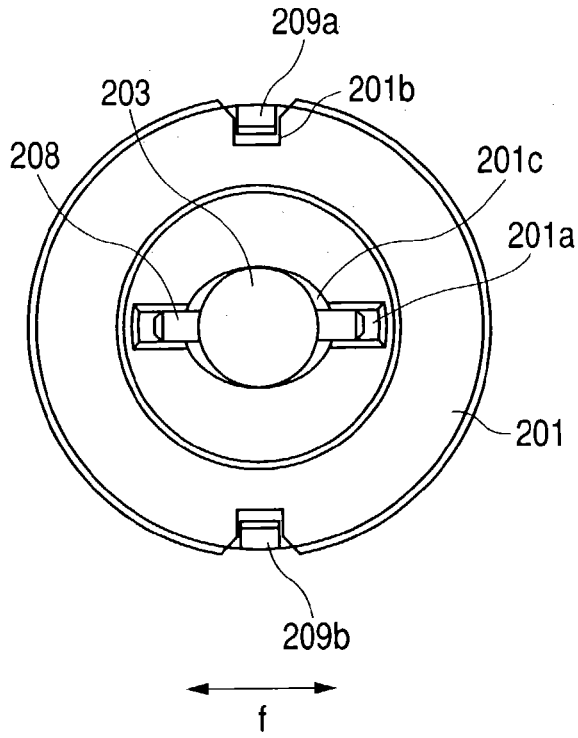
FIG. 9 is a front view of a drum flange which is an undesirable example.

As for the engagement relation between the fixing pin 208 and the flange 201, if the groove 201*a* is provided at the same angle as the long-span direction of the aforementioned ellipse as shown in FIG. 9, the drum shaft 203 is capable of moving in the peripheral direction (direction indicated with arrow f in the same figure) with respect to the through hole 201*c* in the flange, so that a drum position is changed within the image forming apparatus with a rotation of the drum shaft.

Figure 10:
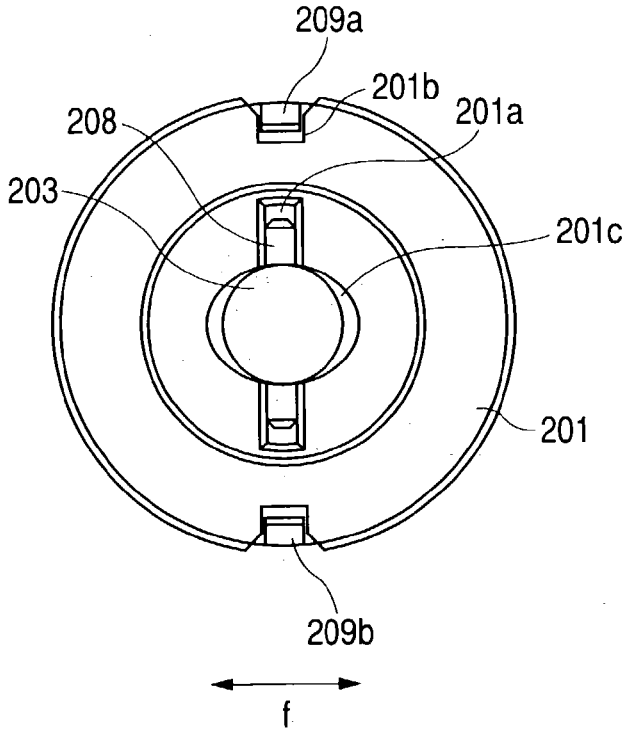
FIG. 10 is a front view of a drum flange according to the embodiment of the present invention.

According to this embodiment, as shown in FIG. 10, the fixing pin 208 is provided at an engaging position (groove 201*a*) in the flange 201 such that the extending direction thereof is in the same direction as the short span of the aforementioned ellipse. Consequently, even if the through hole 201*c* becomes elliptic by the caulking, the flange 201 is capable of engaging the drum shaft 203 without any clearance in the direction indicated with f. This reason is that the fixing pin 208 and the groove 201*c* are formed in dimensions which generates no shakiness as described above. That is, the longitudinal direction of the groove 201*a* is set parallel to or substantially the same as a direction between the caulking portions 209*a* and 209*b* (direction in which the end portion of the cylinder 209 is caulked with the punch 401).

In summarizing the above-described embodiment, the electrophotographic photosensitive drum for use in the electrophotographic image forming apparatus and supported rotatably by the drum shaft 203 comprises the cylinder 209 having the electrophotographic photosensitive body provided on the surface thereof and the flange 201 provided on an end portion in the axial direction of the cylinder 209. The flange 201 includes an outer peripheral portion 201*g*, the hole portion 201*c* engaging the drum shaft 203, and the groove 201*a* extended in the radial direction and engaging the fixing pin 208 provided in the drum shaft 203 in a direction intersecting the drum shaft 203, the groove 201*a* transmitting a driving force of the drum shaft. Then, parts 209*a*, 209*b* of the cylinder are bent inwardly in the radial direction at two positions 201*b* in which the groove 201*a* intersects the outer peripheral portion 201*g* in the extending direction while the two positions oppose each other across the hole portion 201*c*, so as to caulk the flange 201 onto the cylinder.

Figure 13:
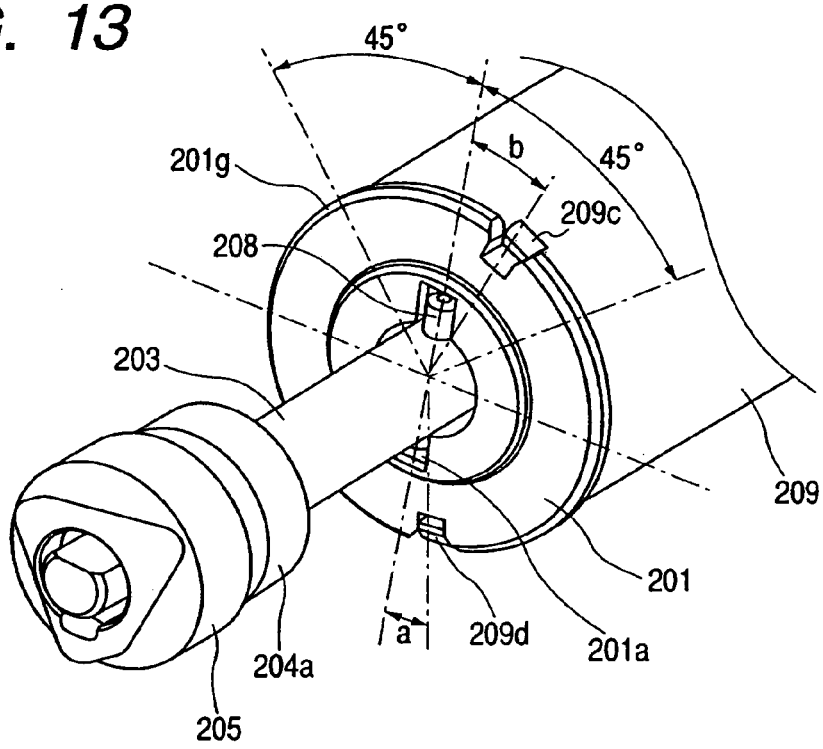
FIG. 13 is a schematic perspective view showing a condition in which the flange is caulked in the photosensitive drum according to the embodiment of the present invention.
Figure 14:
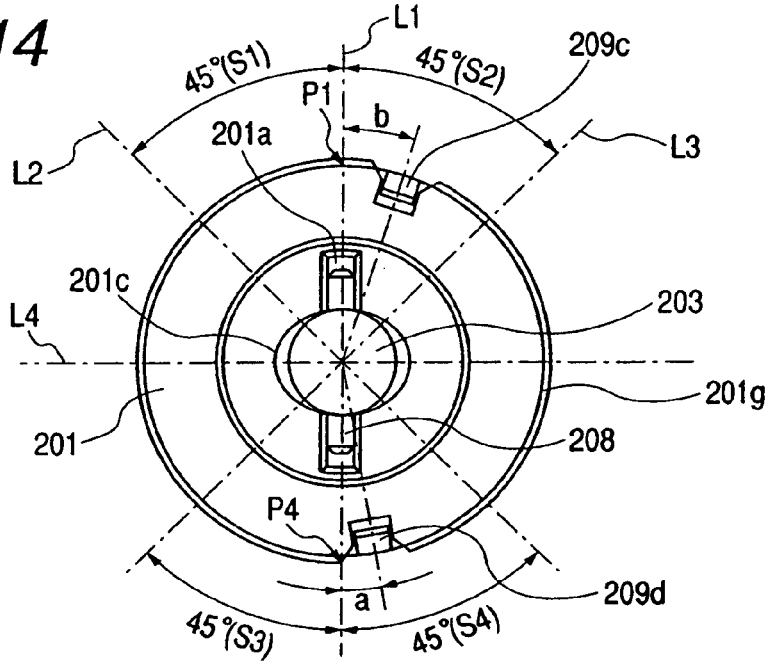
FIG. 14 is a front view of a drum flange according to the embodiment of the present invention.

As shown in FIGS. 13 and 14, parts of the cylinder 209 are bent inwardly in the radial direction to caulk the flange at positions (S1, S2, S3, S4) on the outer peripheral portion between a position (P1, P4) in which the groove 201*a* intersects the outer peripheral portion 201*g* of the cylinder 201 in the extending direction of the groove 201*a* and a position in which a line (L2, L3) passing the center of the hole portion 201*c* and extending at 45° with respect to the extending direction of the groove 201*a* intersects the outer peripheral portion 201*g* of the cylinder 201 (caulking portions 209*c*, 209*d*). The caulking portions 209*c*, 209*d* are provided at two positions which oppose each other across a line L4 intersecting the extending direction of the groove 201*a*. According to this embodiment, part of each of the caulking portions 209*a*, 209*b* is bent inwardly in the radial direction to caulk the flange. The caulking portion 209*c* is located at an angle of b° with respect to an extending direction L1 of the groove 201*a*. Further, the caulking portion 209*d* is located at an angle of a° with the respect to line L1. The configuration shown in FIGS. 13, 14 is capable of securing substantially the same effect as the configuration shown in FIG. 10.

Figure 11:
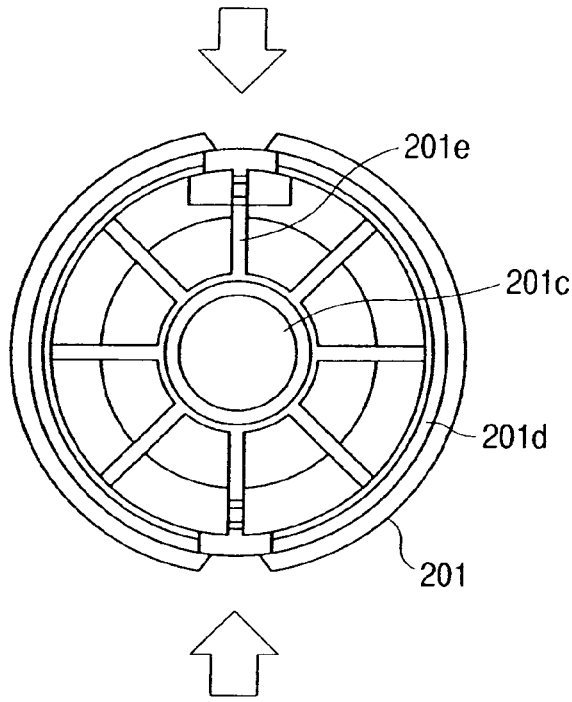
FIG. 11 PRIOR ART
FIG. 11 is a rear view of a conventional drum flange.
Figure 12:
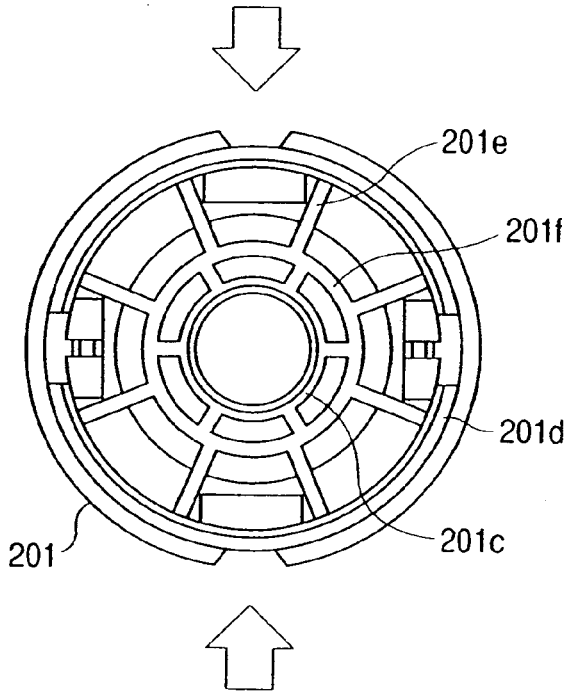
FIG. 12 is a rear view of the drum flange according to the embodiment of the present invention.

Conventionally, as shown in FIG. 11, a radial rib 201*e* is provided between an outer peripheral portion 201*d* and an inner peripheral portion 201*c* on an inner side (face opposite to the face on which the groove 201*a* is provided along the drum axial direction) of the drum flange 201.

According to the present invention, the rib portion 201*e* is deflected from the direction of the arrows shown in FIG. 11 by being pushed with the punch so that the rib portion 201*e* and the direction of the arrows shown in FIG. 11 are not aligned in the diameter direction in order to reduce the influence on the inside diameter portion 201*c* of the flange when the flange is pushed with the punch 401.

Further, a rib 201*f* coaxial with the through hole 201*c* is provided outside the through hole 201*c* so as to protect the through hole 201*c* from a force applied on the rib.

As described above, the process cartridge, which is attachable to/detachable from the electrophotographic image forming apparatus, is comprised of the cylinder 209, which is an electrophotographic photosensitive member and a pair of flanges 201 which engage both ends of the cylinder. The flanges are caulked at two opposing points (209*a*, 209*b*). The caulked portion (209*a*, 209*b*) mentioned here refers to a fallen-down portion or a bent portion of the cylinder bent or fallen down in an inward direction. Further, the flange 201 is comprised of the outer peripheral portion which engages the cylinder 209, the inner peripheral portion which is a hole smaller than the inside diameter of the cylinder and a rib formed radially from the outer peripheral portion to the inner peripheral portion. By deflecting the rib and the caulking point from each other in the circumference direction, the force of the punch is blocked from reaching the through hole formed by the inner peripheral portion of the flange when the flange is caulked on the drum cylinder. Consequently, the photosensitive drum can be supported accurately without deforming the through hole on the inner peripheral portion of the flange, in which the photosensitive-drum supporting shaft fits.

Further, the process cartridge, which is attachable to/detachable from the electrophotographic image forming apparatus main body, is comprised of the cylinder, which is an electrophotographic photosensitive member, and the pair of flanges which engage both ends of the cylinder. The flange is caulked at two opposing points. The caulking mentioned here refers to a falling down portion of the cylinder fallen down in an inward direction. Further, the flange has the outer peripheral portion that engages the cylinder and an inner peripheral portion which is a hole smaller than the inside diameter of the cylinder. The flange also includes the groove 201*a* which passes through the center of its axis perpendicularly to the axial direction and the groove 201*a* is so constructed that the caulking portions 209*a*, 209*b* are located on an extension in the axial direction of the flange fixing pin that engages the same groove 201*a*. Thus, even if the through hole 201*c* on the inner peripheral portion of the flange is deformed by a force of the punch 401 when the flange 201 is caulked on the drum cylinder 209, the photosensitive drum supporting shaft 203 can be fit to the flange 201 without any clearance thereby accurately supporting the photosensitive drum.

Because the photosensitive drum is supported accurately, an image forming apparatus which ensures a high printing accuracy and has no unevenness in formed image can be provided.

As for the effect of the present invention, as described above, even if the cylinder and the flange are coupled with each other by caulking, excellent rotation accuracy of the electrophotographic photosensitive drum can be maintained. Further, even if this caulking is made between the cylinder and the flange, deformation of the hole portion can be blocked in order to rotatably support the electrophotographic photosensitive drum. Moreover, in the electrophotographic photosensitive drum, looseness—resisting strength and rotation-resisting strength between the flange and the cylinder can be improved.

What is claimed is:

1. An electrophotographic photosensitive drum for use in an electrophotographic image forming apparatus and supported rotatably by a drum shaft, comprising:

a cylinder having an electrophotographic photosensitive member provided on the surface thereof; and flanges provided on end portions of said cylinder in the axial direction of said cylinder, wherein at least one of said flanges has an outer peripheral portion, a hole portion engaging the drum shaft, multiple ribs extending radially in the radial direction and an annular rib provided between said outer peripheral portion and said hole portion in the radial direction, and wherein said at least one of said flanges is caulked by bending at least one part of said cylinder inwardly in the radial direction at two positions opposing each other across said hole portion, the two positions being other than positions on said outer peripheral portion intersected by the direction in which said multiple ribs extend.

2. An electrophotographic photosensitive drum according to claim 1, wherein said at least one of said flanges has a concave portion provided in said outer peripheral portion and part of said cylinder is bent inwardly in the radial direction and caulked to said at least one of said flanges.

3. An electrophotographic photosensitive drum according to claim 1, wherein said electrophotographic photosensitive drum is mounted on a process cartridge attachable to/detachable from the main body of the electrophotographic image forming apparatus, and said electrophotographic photosensitive drum is used for forming an image on a recording medium when the process cartridge is mounted on the main body of the electrophotographic image forming apparatus.

4. A process cartridge attachable to/detachable from an electrophotographic image forming apparatus, comprising:

(i) a cartridge frame body;

(ii) a drum shaft supported by said cartridge frame body;

(iii) an electrophotographic photosensitive drum rotatably supported by said drum shaft, including:

a cylinder having an electrophotographic photosensitive member provided on the surface thereof; and flanges provided on end portions of said cylinder in the axial direction of said cylinder, wherein at least one of said flanges has an outer peripheral portion, a hole portion engaging said drum shaft, multiple ribs extending radially in the radial direction and an annular rib provided between said outer peripheral portion and said hole portion in the radial direction, and wherein said at least one of said flanges is caulked by bending at least one part of said cylinder inwardly in the radial direction at two positions opposing each other across said hole portion, the two positions being other than positions on said outer peripheral portion intersected by the direction in which said multiple ribs extend; and (iv) process means for acting for said electrophotographic photosensitive drum.

5. A process cartridge according to claim 4, wherein said at least one of said flanges has a concave portion provided in said outer peripheral portion and at least one part of said cylinder is bent inwardly in the radial direction and caulked to said at least one of said flanges.

6. An electrophotographic photosensitive drum for use in an electrophotographic image forming apparatus and rotatably supported by a drum shaft, comprising:

a cylinder having an electrophotographic photosensitive member provided on the surface thereof; and flanges provided on end portions of said cylinder in the axial direction of said cylinder, wherein at least one of said flanges has an outer peripheral portion, a hole portion engaging the drum shaft, and a groove which engages a fixing pin provided in the drum shaft in a direction intersecting the drum shaft, wherein said groove extends in the radial direction and transmits a driving force of the drum shaft, said groove having a width accommodating insertion of the fixing pin into said groove in the axial direction, and wherein said at least one of said flanges is caulked by bending at least one part of said cylinder inwardly in the radial direction at two positions opposing each other across said hole portion, in a direction in which said groove extends.

7. An electrophotographic photosensitive drum according to claim 6, wherein said at least one of said flanges has a concave portion provided in said outer peripheral portion and part of said cylinder is bent inwardly in the radial direction and caulked to said at least one of said flanges.

8. An electrophotographic photosensitive drum according to claim 6, wherein said at least one of said flanges has a rib extending radially in the radial direction on the face of a side of said at least one of said flanges opposite to the side of said at least one of said flanges on which said groove is provided in the axial direction, and at least one part of said cylinder is caulked at positions other than positions of the outer peripheral portion intersected by a direction in which a plurality of ribs extends.

9. An electrophotographic photosensitive drum according to claim 6, wherein said electrophotographic photosensitive drum is mounted on a process cartridge attachable to/detachable from the main body of the electrophotographic image forming apparatus, and said electrophotographic photosensitive drum is used for forming an image on a recording medium when the process cartridge is mounted on the main body of the electrophotographic image forming apparatus.

10. A process cartridge attachable to/detachable from an electrophotographic image forming apparatus, comprising:

(i) a cartridge frame body;

(ii) a drum shaft supported by said cartridge frame body;

(iii) an electrophotographic photosensitive drum rotatably supported by said drum shaft, including:

a cylinder having an electrophotographic photosensitive member provided on the surface thereof; and flanges provided on end portions of said cylinder in the axial direction of said cylinder, wherein at least one of said flanges has an outer peripheral portion, a hole portion engaging said drum shaft, and a groove which engages a fixing pin provided in said drum shaft in a direction intersecting said drum shaft, wherein said groove extends in the radial direction and transmits a driving force of said drum shaft, said groove having a width accommodating insertion of the fixing pin into said groove in the axial direction, and wherein said at least one of said flanges is caulked by bending at least one part of said cylinder inwardly in the radial direction at two positions opposing each other across said hole portion, in a direction in which said groove extends; and (iv) process means for acting for said electrophotographic photosensitive drum.

11. A process cartridge according to claim 10, wherein said at least one of said flanges has a concave portion provided in said outer peripheral portion and part of said cylinder is bent inwardly in the radial direction and caulked to said at least one of said flanges.

12. A process cartridge according to claim 10, wherein said at least one of said flanges has a rib extending in the radial direction on the face of a side of said at least one of said flanges opposite to the side of said at least one of said flanges on which said groove is provided in the axial direction, and at least one part of said cylinder is caulked at positions other than the positions of the outer peripheral portion intersected by the direction in which a plurality of ribs extends.

13. An image forming apparatus, comprising a loading portion, a process cartridge, carrying means, and transfer means, which allows said process cartridge to be attached thereto and detached therefrom and for forming an image on a recording medium, (i) wherein said loading portion detachably mounts said process cartridge;

(ii) wherein said process cartridge is loaded on said loading portion, said process cartridge including:

a cartridge frame body;

a drum shaft supported by said cartridge frame body; and an electrophotographic photosensitive drum rotatably supported by said drum shaft, said electrophotographic photosensitive drum including:

a cylinder having an electrophotographic photosensitive member provided on the surface thereof; and flanges provided on end portions of said cylinder in an axial direction of said cylinder, wherein at least one of said flanges has an outer peripheral portion, a hole portion engaging said drum shaft, multiple ribs extending radially in the radial direction and an annular rib provided between said outer peripheral portion and said hole portion in the radial direction, and wherein said at least one of said flanges is caulked by bending at least one part of said cylinder inwardly in the radial direction at two positions opposing each other across said hole portion, the two positions being other than positions on said outer peripheral portion intersected by the direction in which said multiple ribs extend;

(iii) carrying means for carrying the recording medium; and (iv) wherein said transfer means transfers an image formed on said electrophotographic photosensitive drum onto the recording medium.

14. An image forming apparatus, comprising a loading portion, a process cartridge, carrying means, and transfer means, which allows said process cartridge to be attached thereto and detached therefrom and which is for forming an image on a recording medium, (i) wherein said loading portion detachably loads said process cartridge;

(ii) wherein said process cartridge is loaded on said loading portion, said process cartridge including:

a cartridge frame body;

a drum shaft supported by said cartridge frame body; and an electrophotographic photosensitive drum rotatably supported by said drum shaft, said electrophotographic photosensitive drum including:

a cylinder having an electrophotographic photosensitive member provided on the surface thereof; and a flange provided on end portions of said cylinder in the axial direction of said cylinder, wherein said flange has an outer peripheral portion engaging said cylinder, a hole portion engaging said drum shaft, and a groove which engages a fixing pin provided in said drum shaft in a direction intersecting said drum shaft, wherein said groove extends in the radial direction and transmits a driving force of said drum shaft, said groove having a width accommodating insertion of the fixing pin into said groove in the axial direction and wherein said flange is caulked by bending at least one part of said cylinder inwardly in the radial direction at two positions opposing each other across said hole portion, in a direction in which said groove extends;

(iii) wherein carrying means for carrying the recording medium; and (iv) wherein said transfer means transfers an image formed on said electrophotographic photosensitive drum onto the recording medium.

15. An electrophotographic photosensitive drum for use in an electrophotographic image forming apparatus and rotatably supported by a drum shaft, comprising:

a cylinder having an electrophotographic photosensitive member provided on a surface thereof; and a flange provided on an end portion of said cylinder in an axial direction of said cylinder, wherein said flange comprises:

an outer peripheral portion;

a hole portion engaging said drum shaft; and a groove which engages a fixing pin provided in the drum shaft in a direction intersecting the drum shaft, wherein said groove extends in the radial direction and transmits a driving force of the drum shaft, said groove having a width accommodating insertion of the fixing pin into said groove in the axial direction, and wherein said flange is caulked by bending at least one part of said cylinder inwardly in the radial direction at two positions located along said outer peripheral portion between a direction in which said groove extends and a direction which forms an angle of 45° with a direction along a line passing a center of said hole portion with respect to the direction in which said groove extends, the two positions being opposed to each other across a line intersecting the extending direction of said groove.

16. A process cartridge attachable to/detachable from an electrophotographic image forming apparatus, comprising:

(i) a cartridge frame body;

(ii) a drum shaft supported by said cartridge frame body;

(iii) an electrophotographic photosensitive drum rotatably supported by said drum shaft, including:

a cylinder having an electrophotographic photosensitive member provided on the surface thereof; and a flange provided on an end portion of said cylinder in the axial direction of said cylinder, wherein said flange includes:

an outer peripheral portion;

a hole portion engaging the drum shaft; and a groove which engages a fixing pin provided in said drum shaft in a direction intersecting said drum shaft, wherein said groove extends in the radial direction and transmits a driving force of said drum shaft, said groove having a width accommodating insertion of the fixing pin into said groove in the axial direction, and wherein said flange is caulked by bending at least one part of said cylinder inwardly in the radial direction at two positions being located along said outer peripheral portion between a direction in which said groove extends and a direction which forms an angle of 45° with a direction along a line passing the center of said hole portion with respect to the direction in which said groove extends, the two positions being opposed to each other across a line intersecting the extending direction of said groove; and (iv) process means for acting on said electrophotographic photosensitive drum.

17. An image forming apparatus, comprising a loading portion, a process cartridge, carrying means, and transfer means, which allows said process cartridge to be attached thereto and detached therefrom and is for forming an image on a recording medium, (i) wherein said loading portion detachably mounts said process;

(ii) wherein said process cartridge is detachably loaded on said loading portion, said process cartridge including:

a cartridge frame body;

a drum shaft supported by said cartridge frame body; and an electrophotographic photosensitive drum rotatably supported by said drum shaft, said electrophotographic photosensitive drum comprising:

a cylinder having an electrophotographic photosensitive member provided on the surface thereof; and a flange provided on an end portion of said cylinder in an axial direction of said cylinder, wherein said flange comprises:

an outer peripheral portion;

a hole portion engaging said drum shaft; and a groove extending in the radial direction and engaging a fixing pin provided in said drum shaft in a direction intersecting said drum shaft, wherein said groove transmits a driving force of the drum shaft, said groove having a width accommodating insertion of the fixing pin into said groove in the axial direction, and wherein said flange is caulked by bending at least one part of said cylinder inwardly in the radial direction at two positions located along said outer peripheral portion between a direction in which said groove extends and a direction which forms an angle of 45° with a direction along a line passing the center of said hole portion with respect to the direction in which said groove extends, the two positions being opposed to each other across a line intersecting the extending direction of said groove; and process means for acting on said electrophotographic photosensitive drum;

(iii) wherein said carrying means carries the recording medium; and (iv) wherein said transfer means transfers an image formed on said electrophotographic photosensitive drum onto the recording medium.

* * * * *

UNITED STATES PATENT AND TRADEMARK OFFICE

CERTIFICATE OF CORRECTION

PATENT NO. : 7,016,626 B2
APPLICATION NO. : 10/609485
DATED : March 21, 2006
INVENTOR(S) : Kanji Yokomori et al.

It is certified that error appears in the above-identified patent and that said Letters Patent is hereby corrected as shown below:

COLUMN 2
Line 23, "t" should be deleted.

COLUMN 5
Line 10, "the" should read --the cylinder--.

Signed and Sealed this

Twenty-second Day of July, 2008

JON W. DUDAS
*Director of the United States Patent and Trademark Office*